United States Patent [19]

Cairns et al.

[11] 3,992,161

[45] Nov. 16, 1976

[54] IRON-CHROMIUM-ALUMINUM ALLOYS WITH IMPROVED HIGH TEMPERATURE PROPERTIES

[75] Inventors: Robert Lacock Cairns; John Stanwood Benjamin, both of Suffern, N.Y.

[73] Assignee: The International Nickel Company, Inc., New York, N.Y.

[22] Filed: Apr. 3, 1974

[21] Appl. No.: 457,436

Related U.S. Application Data

[60] Division of Ser. No. 325,313, Jan. 22, 1973, Pat. No. 3,837,930, which is a continuation-in-part of Ser. No. 218,404, Jan. 17, 1972, abandoned.

[52] U.S. Cl. ..... 29/182.5; 75/124; 75/126 R; 75/126 C; 75/126 D; 75/126 E; 75/126 F; 75/126 G; 75/126 H; 75/128 R; 75/128 B; 75/128 G; 75/128 Z; 75/128 T; 75/128 W; 75/128 V

[51] Int. Cl.[2] ..... B22F 3/00

[58] Field of Search ..... 29/182.5; 75/206, 124, 75/126 R, 126 C, 126 D, 126 E, 126 F, 126 G, 126 H, 128 R, 128 B, 128 G, 128 Z, 128 T, 128 W, 128 V

[56] References Cited

UNITED STATES PATENTS

| | | | |
|---|---|---|---|
| 3,159,908 | 12/1964 | Anders | 29/182.5 |
| 3,346,427 | 10/1967 | Baldwin et al. | 29/182.5 |
| 3,366,515 | 1/1968 | Fraser et al. | 29/182.5 |
| 3,368,883 | 2/1968 | Barnett et al. | 29/182.5 |
| 3,591,365 | 7/1971 | Ohmachi | 75/124 |
| 3,623,849 | 11/1971 | Benjamin | 75/206 |
| 3,720,551 | 3/1973 | Allen | 148/126 |
| 3,837,847 | 9/1974 | Bieber | 75/124 |

OTHER PUBLICATIONS

Wukusick et al., "An Fe—Cr—Al Alloy containing Y" Materials Research & Standards 12/64 p. 637–646.

*Primary Examiner*—Brooks H. Hunt
*Attorney, Agent, or Firm*—Miriam W. Leff; Ewan C. MacQueen

[57] ABSTRACT

A powder metallurgy product comprising iron and chromium, and/or aluminum and characterized by elongated grains that are stable at elevated temperatures.

A method of producing such a product, including mechanically alloying a suitable powder charge, consolidating the mechanically alloyed powder, working the consolidated product so as to achieve therein a reduction of at least about 10%; and, then, heating the worked product to produce coarse elongated grains therein.

The product produced according to the present invention exhibits good oxidation resistance and good room temperature and elevated temperature strength and ductility.

13 Claims, 2 Drawing Figures

IRON-CHROMIUM-ALUMINUM ALLOYS WITH IMPROVED HIGH TEMPERATURE PROPERTIES

This is a division of application Ser. No. 325,313, filed Jan. 22, 1973 now U.S. Pat. No. 3,831,930 which is application is a continuation-in-part of U.S. application Ser. No. 218,404, filed Jan. 17, 1972 now abandoned.

Conventionally-produced iron-based alloys containing chromium and aluminum exhibit oxidation resistance of a high order, even at elevated temperatures, but are of limited practical utility because they exhibit relatively low high-temperature strength, and are generally subject to extreme grain coarsening and grain boundary embrittlement when exposed for extended times to elevated temperatures. Such alloys exhibit negligible room temperature ductility after exposure to high temperature for extended periods of time. As a result of these drawbacks, the use of such alloys has largely been restricted to high-temperature applications at which little strength is required, e.g., electrical resistance heating elements, and to lower temperature applications where corrosion conditions preclude the use of other materials. It is, therefore, desirable to overcome the above-mentioned drawbacks so that such alloys can be used in various other high temperature applications requiring strength and corrosion resistance, such as turbines vanes, burner cans and blades.

It appeared that the problem of drastic loss of ductility in such iron-base alloys upon long-time exposure of the materials to elevated temperature could be solved if the massive grain growth found to occur therein during such elevated temperature exposure could be prevented.

The mechanical alloying process described in U.S. Pat. No. 3,591,362 to Benjamin, provides a method of uniformly distributing dispersoid particles at close spacings in such alloys.

Briefly, in the mechanical alloying process, as described in the above patent, the constituent metal particles of the starting powder charge are integrated together into dense composite particles without melting any of the constituents, this being done by dry milling the powder, usually in the presence of grinding media, e.g., balls, so as to apply to the powder charge, mechanical energy in the form of a plurality of repeatedly-applied high energy, compressive forces. Such high energy forces result in the fracture, or comminution, of the original powder constituents and the welding together of the fragments so produced, as well as the repeated fracture and re-welding of the welded fragments, so that there is brought about a substantially complete codissemination of the fragments of the various constituents of the starting powder. The mechanically alloyed composite powder particles produced in this manner are characterized metallographically by cohesive internal structures in which the constituents are intimately united to provide an interdispersion of comminuted fragments of the starting constituents. Very short distances across the areas corresponding to the fragments of initial materials in the composite particles can be created, e.g., on the order of 3 microns or 1 micron or less, and fine dispersoid particles present in the powder charge can be uniformly distributed throughout the composite particles at short interparticle spacings, e.g., one micron or less.

The mechanical alloying process may be conducted in a variety of equipment, including a stirred ball mill, shaker mill, vibratory ball mill, planetary ball mill, and even certain ball mills provided attention is had to the ball-to-powder ratio of the charge and size of the mill, as taught by the above Benjamin patent.

It has been found particularly advantageous in obtaining optimum results to employ agitation milling under high energy conditions in which a substantial portion of the mass of the attritive elements, e.g., balls, is maintained kinetically in a highly activated state of relative motion. The milling is sufficiently energetic to reduce substantially the thickness of the initial metal constituents by impact compression resulting from collisions with the milling medium, e.g., grinding balls. It has been found advantageous that at least about 40%, e.g., 50% or 70% or even 90% or more, of the attritive elements be maintained in a highly activated state.

By maintaining the attritive elements in a highly activated state of mutual collision in a substantially dry environment and throughout substantially the whole mass, optimum conditions are provided for comminuting and cold welding the constituents, accompanied by particle growth, to produce within each composite particle, a mechanically alloyed structure of the constituents. The resulting composite metal powder will be heavily cold worked and will reach a high hardness level, which becomes substantially constant ("saturation hardness") after a minimum milling time due to impact compression of the particles arising from repeated collision of the attritive elements upon the metal particles, such hardness level providing stored energy to the composite powder particles.

In the interest of providing composite particles of substantially uniform composition and structure, milling is usually conducted beyond the point at which saturation hardness is reached.

We have now discovered a powder metallurgy process for producing iron-base alloys containing chromium and/or aluminum, which is based upon the use of mechanically alloyed powders and which provides alloys having markedly improved properties over a range of temperatures up to at least about 2000° F. We have also discovered processing cycles which provide such alloys with a stable, elongated grain structure having improved strength at elevated temperatures and having good ductility over a wide range of temperatures, permitting the prevision of mill products, including sheet, plate, wire, rod, tubing, etc., of greatly enhanced utility as compared to such articles produced by conventional means. Such grains provide to the consolidated products significant improvement in the tensile and stress-rupture strengths and ductility at elevated temperatures.

It is therefore an object of this invention to provide an iron base material having improved high temperature strength.

It is a further object to provide such an iron base material that exhibits good room temperature ductility even after extended exposure to high temperature.

It is still another object to provide an iron base material that exhibits grain-stability at elevated temperatures.

These and other objects will become more apparent when taken in conjunction with the following description and the accompanying figures, wherein.

Figure 1:
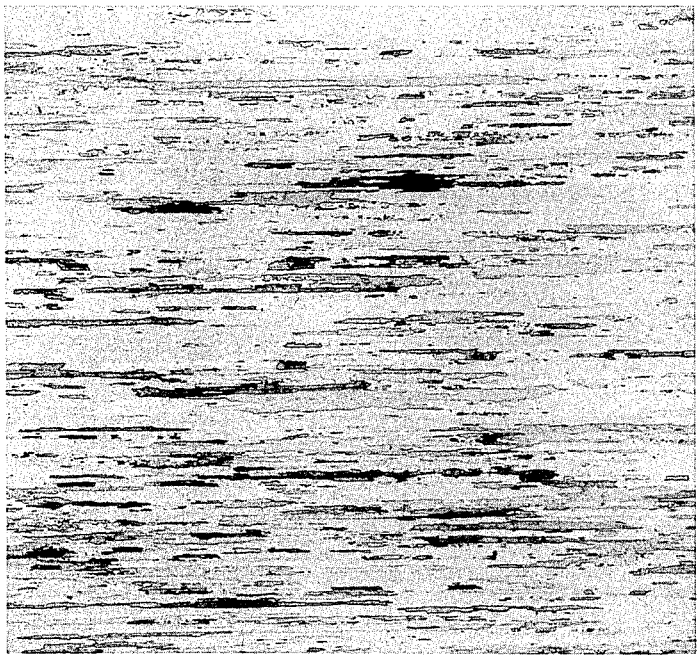
FIG. 1 is a photomicrograph taken at 50 diameters of an iron-base product made according to the present invention, which product was cold-rolled 50% and grain coarsened by heating at 2400° F. 1 hour.

Generally speaking, the present invention includes the mechanical alloying of powder charges containing by weight, about 10% to about 40% chromium; up to about 10% aluminum, e.g., about 1% to about 10% aluminum; up to about 20% cobalt; up to about 10% nickel; up to about 5% titanium; up to about 2% each of rare earth metal, yttrium, zirconium, columbium, hafnium, tantalum, silicon, and/or vanadium; up to about 6% each of tungsten and molybdenum; and the balance essentially iron, and further including by volume, up to about 10% finely divided dispersoid material consisting of oxides, nitrides, carbides, borides and other refractory materials, which dispersoid material has a melting point of at least about 2750° F.; hot consolidating the mechanically alloyed powder to a substantially completely dense body (e.g., about 98% theoretical density or more); working the consolidated body at a temperature within the range up to about 1600° to 1700° F. to achieve a reduction of about 10% to 15% or more therein; and then heating the worked body to an elevated grain-growth temperature to produce coarse grains elongated in the direction or directions of working and to provide improved stress-rupture properties therein.

More preferably, the powder charge and consolidated material produced therefrom contain, by weight about 15% to 40% chromium, and even more preferably, about 18% to about 26% chromium; up to about 5% cobalt; up to about 6% nickel; about 1% to about 7% aluminum, e.g., about 3% to 7% aluminum; up to about 0.5% zirconium; up to about 1% titanium; about 0.1% to about 10% or more preferably, about 0.25% to 5% dispersoid in the form of a finely divided, well-distributed refractory dispersoid; such as a refractory oxide, including alumina, lanthana, yttria, ceria, titania, silica, zirconia, hafnia, for example; a metal carbide; and/or a metal nitride, such as zirconium nitride; and the balance essentially iron. Elements such as carbon and manganese are regarded as impurities and may be present in amounts up to about 0.4% each. The dispersoid particles preferably have a particle size of about 50A to 5000A, more preferably about 100A to 1000A, and have average interparticle spacings of about 500A to about 2500A, more preferably, about 660A to about 1800A.

More specifically, in one embodiment of the present invention, the mechanical alloying operation is carried out in a stirred ball mill, e.g., a Szegvari attritor, provided with an attrition medium comprising balls having an average diameter of 0.1 to 0.5 inches and running at an impeller speed of about 50 to 350 RPM. The balls are present in an amount sufficient to provide a ball-to-powder ratio, preferably, of about from 4 to 1 to about 50 to 1. It is preferred that higher impeller speeds be employed in mechanical alloying with stirred ball mills having relatively small powder chambers and lower impeller speeds be employed with relatively large such chambers; for example, with chambers having respective diameters of about 9 and about 36 inches, the respective impeller speeds can be about 300 to 400 PRM and about 70 to 100 RPM. The mechanical alloying operation preferably is carried out for a time sufficient, in the particular milling device employed, to ensure the substantial homogeneity of the final composite particles and to impart substantial saturation hardness to the composite particles. Experience indicates that milling times of about 10 to about 40 hours, e.g., about 15 to about 20 hours, are usually sufficient in a high energy mill such as the attritor.

It is preferred that the mechanical alloying operation be conducted in an inert atmosphere such as argon and, preferably at a flow rate sufficient to prevent substantial infiltration of air into the mill, e.g., about 5 cu. ft. of argon per hr. in a mill having an internal volume of 10 to 15 gallons, so that the uncontrolled pickup of gases such as oxygen and nitrogen in the powders is minimized. It appears that the presence of excessive oxygen, and possibly also nitrogen, in the mill atmosphere during milling can hinder the welding factor which desirably occurs during mechanical alloying, may lead to the production of undesirably fine powders and contribute to inhomogeneity. Preferably, the amount of nitrogen and of oxygen in the powder, other than that present in the dispersoid material, due to atmosphere pickup in milling, does not exceed about 0.4% oxygen and 0.2% nitrogen. Satisfactory composite powders generaly have average particle sizes in the range 10 to 1000 microns, e.g., about 20 to 200 microns.

In satisfactory mechanically alloyed, i.e., composite, powders produced from powder mixtures containing dispersoid powder, the dispersoid ingredient is present in the powder in a total amount of, by volume, about 0.1% to 10% and is well distributed throughout the composite at average interparticle distances from about 500 to 2500 Angstroms. Once this dispersoid content and distribution has been established in the powder, it is carried forward into the consolidated material. It is found that the characteristic high hardness, or saturation hardness, is developed in the composite powder after relatively short milling periods and this hardness will generally be on the order of 630 Vickers Hardness Number. The composite powder is dense and substantially devoid of internal porosity such that it withstands penetration by a diamond pyramid indenter. Generally, milling is continued substantially beyond the point at which substantial saturation hardness is achieved in the composite powder for the purpose of further improving the homogeneity of the powder with beneficial results in terms of strength and ductility in consolidated powders made therefrom, as well as avoidance of segregated areas in the consolidated material made therefrom.

The powder charges that can be converted to mechanically alloyed powders having the compositional requirements set forth herein, may include iron powder, e.g., sponge iron, reduced mill scale, decarburized carbonyl iron powder, etc., generally having a particle size not exceeding 100 mesh. Chromium may be introduced into the charge as chromium powder, e.g., electrolytic chromium having a particle size not exceeding 100 mesh, or ferrochromium powder containing about 50% to 80% chromium and not more than about 0.2% carbon, and the balance iron, having a particle size not exceeding 100 mesh. Aluminum may be introduced as an iron-aluminum master alloy powder containing 50% to 80% aluminum and the balance iron and other desired ingredients, e.g., iron, chromium, aluminum, etc. Additionally, the chromium and the aluminum, when desired, can be incorporated into the initial powder mixture as an iron-chromium-aluminum master alloy powder. It is preferred that the nitrogen content of the initial powder charge be sufficiently low to provide mechanically alloyed powder containing less than 0.2 weight per cent nitrogen.

The mechanically alloyed composite powders are thereafter hot consolidated as, for example, by canning (in a can which may be mild steel, stainless steel, nickel, etc., and which is welded shut after filling with powder) and hot extruding the powder, or by other hot compaction steps. Powder extrusion can be carried out at an elevated temperature up to 1600° F. or higher, e.g., 2000° F. or 2400° F., the extrusion ratio preferably being about 5:1 to 50:1 or higher. The consolidated powder products can then be fabricated into various shapes; for example, the consolidated powder products can be hot and/or cold rolled to plate or sheet, or rolled, swaged or drawn to bar, rod or wire. Such fabrication can be carried out at elevated temperatures, e.g., up to about 2000° F. or even higher, or at ambient temperature, intermediate anneals preferably being utilized in the latter case (i.e., fabrication at ambient temperature) after reductions of about 30%.

The consolidated product is then worked (i.e., drawn, forged, rolled, etc.) at temperatures not exceeding about 1600° to 1700° F. so as to permit the production of coarse, elongated grains on subsequent heat treatment. Heat treatement of the consolidated product without post-consolidation working thereof generally does not result in coarse, elongated grains. The required amount of working of the consolidated product generally decreases with increasing dispersoid content thereof and is preferably about 10% to 12% reduction or more; for example, a cold-working reduction of about 16% to about 25% or more can be employed with a consolidated product having a total dispersoid content of up to about 1 to 2 volume percent.

In general, the amount of working of the consolidated product before the grain-coarsening, or secondary recrystallization, heat treatment and the grain-coarsening heat-treatment temperature that are required to achieve elongated, relatively coarse grains are a function of the amount of stored energy in the consolidated product. Usually, higher amounts of such stored energy can be produced by mechanically alloying for longer periods of time and/or consolidating, e.g., by extrusion, the mechanically-alloyed powder at lower temperatures and/or with greater amounts of working or deformation of the powder. It is generally desired that the amount of working before the grain-coarsening heat treatment be sufficient to induce strains, i.e., provide stored energy, throughout the consolidated product so that course, elongated grains can subsequently be generated substantially completely throughout the product.

Following such working, the product is subjected to a grain-coarsening heat treatment at an elevated temperature which may be about 2200° F. up to a temperature below the incipient melting point of the alloy. In some cases, for example, when the mechanical alloying operation is conducted for longer times or when extrusion conditions including extrusion strain rate, are more severe or when greater amounts of working are accomplished, or when lower dispersoid contents, e.g, less than about 1% by volume, are present in the consolidated alloy, the grain-coarsening heat treatment can be conducted at significantly lower temperatures, e.g., temperatures as low as 1600° F. In terms of stress-rupture properties, it appears that no significant difference results whether grain coarsening occurs at a relatively low temperture or at a higher temperature. Grain coarsening is itself the significant parameter and the phenomenon does not occur unless work is imparted to the material after hot consolidation. It is generally found that higher temperatures are required where the product includes about 0.5% or more, by weight, zirconium, or where the powder is mechanically alloyed for relatively short periods, e.g., about 15 hours. Such heating results in grain growth, wherein the grains of the product grow to a definite desired size that is not substantially exceeded even after subsequent sustained exposure to temperatures approaching the melting point of the alloy, e.g., about 2350° to 2400° F. for 100 hours or more, which grains are elongated in the direction or directions of working and generally have dimensions in the range of about 10 to 100 microns wide and about 50 to 2000 microns long, when viewed two-dimensionally. Such larger grains provide significant improvement in high temperature tensile and stress-rupture strengths. Products made according to the invention also exhibit elevated temperature grain stability, room temperature workability, comparatively high room-temperature tensile strength, and reduced tendency for embrittlement at ambient temperatures after extended exposure to elevated temperature.

As an alternative to the addition of dispersoid particles directly to the initial powder charge, such dispersoid particles can be produced by adding precursor material to the initial powder charge and thereafter converting such precursor material to the appropriate dispersoid composition. For example, there can be added to the initial powder charge particles of zirconium metal and/or misch metal, after which the zirconium and/or misch metal is converted to the oxide form (i.e., zirconia, lanthana, ceria, etc.). Such conversion to the dispersoid composition can be achieved, for example, by introducing controlled amounts of oxygen into the charge before or during the mechanical alloying operation. Thus, a readily reducible metal oxide such as iron oxide, nickel oxide, etc., having a negative free energy of formation substantially below 90 kilocalories per gram atom of oxygen at 25° C. can be added to the powder charge, or oxygen gas can be included in a mixture with argon during milling, so as to form a fine dispersoid oxide by diffusion and internal oxidation when the resulting powder is hot consolidated. Where the desired dispersoid particles are nitrides, (e.g., ZrN), controlled amounts of nitrogen can be introduced into the mill in the form of nitrogen gas mixed with argon, for example. While oxide and nitride compounds have been mentioned as dispersoid particle compositions, other types of dispersoid materials can also be used in the present invention, e.g., up to about 10% of one or more hard phases, such as carbides, borides, and the like. Refractory compounds which may be included in the powder mix or produced in situ include oxides, carbides, nitrides, borides of such refractory metals as thorium, zirconium, hafnium, titanium, and even such refractory oxides as those of silicon, aluminum, yttrium, cerium, uranium, magnesium, calcium, beryllium and the like. In general, the refractory dispersoid material has a preferred melting point of at least about 2750° F. The refractory oxides generally include the oxides of those metals whose negative free energy of formation of the oxide per gram mole of oxygen at about 1000° C. is at least about 150 kilocalories. The refractory nitrides include those metal nitrides having a negative free energy of formation of at least about 25 kilocalories per gram mole of nitrogen at 1000° C. and the refractory carbides include metal carbides having a negative free energy of formation of at least about 15 kilocalories per gram atom of carbon at 1000° C.

EXAMPLE I 8.5 kilograms of a powder mixture comprising, by weight, 28.7% minus 100 mesh ferrochromium powder, 1% cobalt powder, having an average particle size of 5 microns, 61% minus 100 mesh iron powder, 6% minus 100 mesh ferroaluminum including 65% aluminum, 2.5% minus 100 mesh ferroaluminum including 65% aluminum and 10% cerium-free misch metal, 0.3% of ferrocolumbium including 67% columbium and 0.5% of ferrozirconium including 10% zirconium, was mechanically alloyed for a period of 18 hours in a 10-gallon capacity Szegvari attritor. The mechanical alloying was carried out with 380 lbs. of 5/16-inch diameter steel balls, providing a ball-to-powder ratio of 20 to 1, at an impeller speed of 180 RPM and in an argon atmosphere provided by an argon stream flowing at 5 cubic feet per hour. A portion of the mechanically alloyed powder was canned and extruded at 1950° F. from 3½ inches to a ¾-inch diameter bar which had the composition, by weight, 5.7% aluminum, 21.5% chromium, 0.9% cobalt, 0.16% manganese, 0.15% nickel, 0.016% zirconium, 0.035% carbon, 0.24% oxygen, (% niobium not determined), 0.12% nitrogen, and the balance essentially iron, the total dispersoid content, including rare earth oxides, of the bar being about 1%. A portion of the extruded bar was subsequently bar rolled at room temperature to a strain of 40% reduction in area, and annealed for 1 hour at 2400° F. The bar exhibited grain growth as evidenced by grains having average dimensions of about 100 microns in width and about 1000 microns in length.

Another portion of the same extruded bar was cold-bar rolled by 50% reduction in thickness and subjected to a grain-coarsening heat treatment at 2400° F. for 2 hours, the resulting grains (FIG. 1) having an average size of about 2000 microns long by about 100 microns wide. The thus treated bar survived a step-loaded stress-rupture test at 1900° F. comprising 162.7 hours at 5,000 psi, 47.9 hours at 6000 psi, 24 hours at 7000 psi, and 24 hours at 8000 psi, with the final duration being 33.4 hours at 9000 psi. The bar broke with 2.5% elongation and 7% reduction in area.

EXAMPLE II

Figure 2:
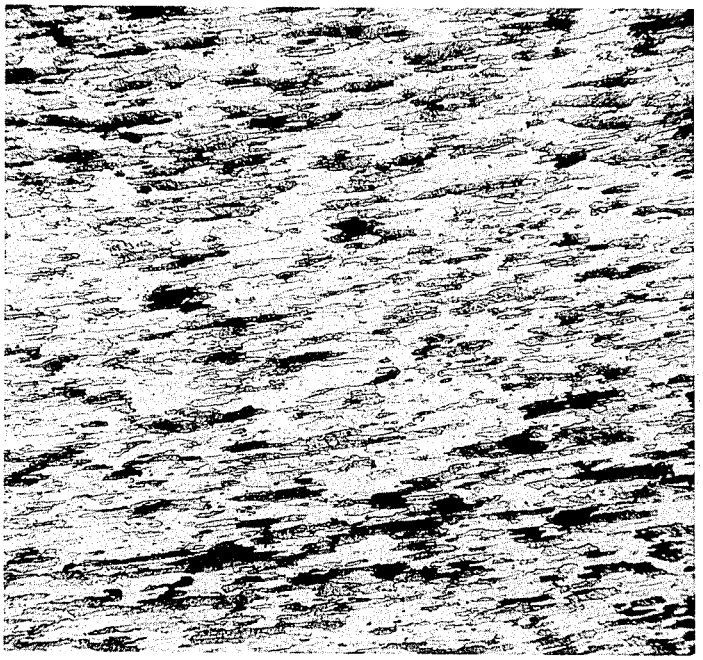
FIG. 2 is a photomicrograph taken at 100 diameters of a wire produced according to the present invention which wire was exposed to a temperature of 2400° F. for 160 hours.

An extrusion having the same composition as that described in Example I was produced with a powder mixture and under the processing conditions similar to those described in Example I, except that the mechanical alloying time in this instance was 12 hours. The extrusion, which was fine grained, was turned to a 0.4-inch diameter and drawn at room temperature to a 0.277-inch diameter rod which was then annealed at 2000° F. for one hour and further drawn to about 0.1-inch diameter, i.e., a severe reduction of about 90%, without intermediate anneals. The wire was annealed at 2400° F. for various times of ½ to 160 hours, the wire grains, after each of the annealing times being elongated in the working directions and being, on the average, about 200 microns long and about 20 microns wide, as illustrated in FIG. 2, which is the grain structure of the 160 hour annealed wire. The relative uniformity of grain size of the wires annealed at the various temperatures indicates the grain stability that is present therein at elevated temperatures. For comparison, a commercially available ¼-inch diameter wire of the composition by weight, 5.55% aluminum, 21.0% chromium, 0.85% cobalt, 0.1% manganese, 0.1% silicon, 0.25% titanium, 0.19% nickel, 0.19% rare earth metal, balance iron, was heated at 2400° F. for 170 hours. The commercial wire, which had an average initial grain size of about 40 microns, exhibited very extensive, uncontrolled grain growth as a result of the high temperature heating, the grown grains of the commercial wire being essentially equiaxed and having an average size of 1200 microns.

To determine the effects of exposure to high temperature or their room temperature properties, another piece of the above commercial wire and a second dispersion-strengthened wire, which was similar in composition to that above and was produced in the manner described above except that it was grain coarsened by heating for ½ hour at 2400° F., were annealed at 2400° F. for various times and then tested at room temperature. The various exposure times and the test results are indicated at Table I, from which it can be seen that the commercial wire is embrittled after only a short exposure, (i.e., less than 2.5 hours) at 2400° F., but that the grain coarsened wire is strong and ductile at room temperature even after 120 hours at 2400° F. The poor ductility of the dispersion strengthened wire in the as-drawn condition can be attributed to the severe cold working that it underwent in the drawing operation.

TABLE I

| Room Temperature Properties | | | | |
|---|---|---|---|---|
| Annealing Time at 2400° F. (Hours) | 0.2% Y.S., (ksi) | U.T.S., (ksi) | El., (%) | R.A., (%) |
| Commercial 1/4" Diameter Wire Bar | | | | |
| 0 | 85.3 | 109 | 27.5 | 69.0 |
| 2.5 | 70 | 78 | 3.5 | 2.0 |
| 6.0 | 66 | 75 | 2.8 | 2.2 |
| 70.0 | 67 | 75 | 2.0 | 2.5 |
| 170.0 | — | 57 | <1.0 | <1.0 |
| 0.10" Diameter Dispersion-Strengthened Drawn Wire | | | | |
| As Drawn | 176 | 204 | 0.0 | 0.0 |
| 120 | 86 | 110 | 15.0 | — |

Another commercial ¼ inch-diameter wire bar and a third grain-coarsened 0.10 inch-diameter dispersion strengthened wire, which had been produced in the above manner and grain coarsened by heating at 2400° F. for ½ hour, were tested at 1900° F. for, respectively, static mechanical properties, i.e., yield strength (Y.S.), ultimate tensile strength (U.T.S.), elongation (El.) and reduction in area (R.A.) and stressrupture strength, the results being set out in Table II.

TABLE II

| 1900° F. PROPERTIES | | | | |
|---|---|---|---|---|
| Commercial Wire | | | | |
| 0.2% Y.S., (ksi) | U.T.S., (ksi) | El., (%) | R.A., (%) | |
| 1.4 | 2.4 | 120 | 95 | |
| Dispersion Strengthened Wire | | | | |
| | Stress (ksi) | Life (hrs.) | | |
| | 5 | 13.3 | | |

From these results, it is expected that the commercial wire would have a 1900° F. stress-rupture life of about zero hours at stresses of about 22.4 ksi or higher. It appears therefore, that the grain-coarsened, dispersion-strengthened wire, exhibiting a 1900° F. stress-rupture life at 5 ksi of 13.3 hours, is considerably superior to the commercial wire under these conditions.

EXAMPLE III

A portion of the mechanically alloyed powder described in Example I was canned and hot compacted in a closed extrusion container at 2100° F. to form a 3-½ inch diameter compact having fine grain size. The compact was heated to 2100° F. and rolled from 3-½ inch diameter round to a 3-inch square and then to a 2 inch thick rectangle which was cross-rolled to 1-inch thick plate. The plate was reheated to 2100° F. and rolled to 0.25-inch plate. The plate was annealed at 1800° F. for 2 hours, decanned by pickling and then cold-rolled to 0.190 inches, after which the plate was annealed at 2200° F. for ½ hour to achieve grain coarsening. No difficulty was encountered in either hot or cold rolling. The sheet exhibits the same type of grain structure as that described in Example II, i.e., elongated grains of relatively large size (about 200 microns long and 20 microns wide) produced by grain growth.

EXAMPLE IV

Various powder lots having compositions adjusted to provide product compositions shown in Table III were mechanically alloyed in a 10 gallon capacity Szegvari attritor at an impeller speed of 180 RPM and under a dynamic argon atmosphere flowing at 5 cubic feet per hour for the mechanical alloying times given in Table III.

TABLE III

| Powder No.(1) | Element Weight Percent C | Ni | Cr | Al | Co | O | N | Zr | Total Rare Earth Oxide $Y_2O_3$ |
|---|---|---|---|---|---|---|---|---|---|
| 1 | .04 | .35 | 21.3 | 4.6 | .93 | .37 | .09 | .10 | .18 |
| 2 | .034 | .26 | 21.7 | 4.6 | .88 | .36 | .11 | .11 | .45 |
| 3 | .025 | .26 | 22.1 | 4.5 | .89 | .46 | .05 | .12 | .72 |
| 4 | .026 | .24 | 20.7 | 4.3 | .85 | .35 | .06 | .03 | .45 |
| 5 | .029 | .19 | 21.5 | 4.1 | .80 | .36 | .06 | .5 | .44 |
| 6 | .026 | .21 | 21.9 | 4.2 | .86 | .47 | .07 | .08 | .76 |
| 7 | .034 | .22 | 21.0 | 4.2 | .79 | .48 | .09 | .06 | .76 |

(1) = Powder Nos. 1 through 5, 6, and 7 mechanically alloyed for 15, 24, and 36 hours, respectively. Balance of each powder essentially iron.

Each mechanically alloyed powder was canned in a 3-½ inch diameter mild steel can and consolidated without evacuation of the can by extruding at 2000° F. to ¾-inch diameter bars, which were then turned to 0.664-inch diameter. When portions of the bars were heated at 2400° F. for ½ hour in an attempt to achieve grain coarsening therein, no grain coarsening resulted. Bars produced from powder Nos. 1, 2, 3, 6 and 7 were then individually rolled at room temperature to various reductions of 16 to 41%. A portion of each bar was removed after each reduction step, each of these portions then being heated at 2400° F. for ½ hour and inspected for grain coarsening, the results being given in Table IV, where the consolidated products are assigned the same numbers as their corresponding powders.

The dispersoid particles generally ranged in size from about 150A to about 500A, with average interparticle spacings of about 1100A for Bar No. 1, about 800A for Bar Nos. 2, 4 and 5, and 7, these values occurring in both the extrusions and in the grain-coarsened products.

TABLE IV

| Bar No. (2) | Grain Coarsening (Percent) COLD REDUCTION 0% | 16% | 25% | 35% | 41% |
|---|---|---|---|---|---|
| 1 | 0 | 100 | 100 | 100 | 100 |
| 2 | 0 | 0 | 100 | 100 | 100 |
| 3 | 0 | 50 | 100 | 100 | 100 |
| 6 | 0 | 100 | 100 | 100 | 100 |
| 7 | 0 | 100 | 100 | 100 | 100 |

(2) = Each bar annealed at 2400° F. for 1/2 hour after cold rolling.

From Table IV, the bars that were tested, (i.e., Nos. 1 to 3, 6 and 7) did not grain coarsen, i.e., secondary recrystallize, under the heating conditions employed until some cold deformation was produced therein. While Bar No. 2 did not grain coarsen until the cold deformation thereof had reached 25%, Bar Nos. 1, 6 and 7 were fully grain coarsened and Bar No. 3 was 50% grain coarsened after the 16% reduction and heat treatment. Each one of these bars was fully grain coarsened, i.e., comprised substantially completely of coarse, elongated grains, after cold reductions of 25% or more and heat treatments at 2400° F. for ½ hour.

EXAMPLE V

Various portions of each one of the extrusions, Nos. 1 through 7, described in Example IV were cold-rolled to achieve a 25% reduction therein and then heated for ½ hour at various temperatures from 1600° to 2400° F., after which the thus-treated bars were metallographically examined for the presence of coarse, elongated grains, the results being given in Table V.

TABLE V

| Bar No.(3) | Annealing Temperature (° F. For ½ Hour) 1600 | 1800 | 1900 | 2000 | 2200 | 2400 |
|---|---|---|---|---|---|---|
| 1 | 100 | 100 | — | 100 | — | 100 |
| 2 | 0 | 0 | — | 0 | 75 | 100 |
| 3 | 0 | 0 | — | 0 | 100 | 100 |
| 4 | 30 | 100 | — | 100 | — | 100 |
| 5 | 0 | 0 | — | 0 | 100 | 100 |
| 6 | 40 | 50 | — | 100 | — | 100 |
| 7 | 0 | 0 | 20 | 100 | — | 100 |

(3) = Each bar cold rolled 25% reduction before anneal.

From Table V, all of the bars displayed a relatively coarse, elongated grain after cold rolling 25% reduction and heating for ½ hour at a temperature of 2400° F. Comparing Bars No. 2 and 3 with Bar No. 1, it appears that the grain coarsening temperature under these conditions, increases with higher dispersoid contents (Table III). Comparing Bars No. 4 and 5, it appears that the grain coarsening temperature under these conditions also increases with higher zirconium contents (see Table III), the zirconium being thought to form additional dispersoid material, such as an oxide, carbide or nitride. Comparison of Bars No. 3 and 6 leads to the conclusion that, under these conditions of cold work and heat treatment, the temperature needed for total grain coarsening decreases with longer mechanical alloying times.

EXAMPLE VI

Various products made from the mechanically alloyed powders described in Example IV were tested for 1900° F. stress-rupture in the as-extruded, 25% cold worked, and 25% cold worked and grain coarsened (annealed at 2400° F. for ½ hour) conditions, the results being given in Table VI, where the bar numbers are the same as those of the corresponding powders. Estimated 100-hour rupture stresses are also set out in Table VI.

TABLE VI

1900° F. Stress Rupture (4)

| Bar No. | As Extruded Stress | As Extruded Life | As Extruded Elong. | Estimated Stress for 100 Hour Life (ksi) | Cold Worked 25% Stress | Cold Worked 25% Life | Cold Worked 25% Elong. | Estimated Stress for 100 Hour Life (ksi) | Cold Worked 25% and Annealed (½ 2400° F.) Stress | Cold Worked 25% and Annealed (½ 2400° F.) Life | Cold Worked 25% and Annealed (½ 2400° F.) Elong. | Estimated Stress for 100 Hour Life (ksi) |
|---|---|---|---|---|---|---|---|---|---|---|---|---|
| 1 | 5 | 0.4 | 6.4 | 2.4 | 5 | 3.1 | 2.4 | 3.5 | 7 | 0.1 | 8.8 | 3.5 |
| 2 | 5 | 6.2 | 4.0 | 3.7 | 5 | 68.4 | 4.0 | 4.8 | 7 | 27.5 | 0.0 | 6.2 |
| 3 | 5 | 0.1 | 33.6 | 2.5 | 5 | 13.3 | 0.8 | 4.1 | 7 | 17.7 | 1.2 | 5.8 |
| 4 | 5 | 0.1 | 39.2 | 2.5 | 5 | >350.0 | — | >5.6 | 7 | 101.9 | 2.4 | 7.0 |
| 5 | 4 | 1.2 | 8.8 | 2.6 | 5 | 54.1 | 1.6 | 4.7 | 7 | 5.1 | 4.1 | 5.2 |
| 6 | 4 | 1.1 | 9.6 | 2.6 | 5 | 2.0 | 4.0 | 3.4 | 6 | 1.0 | 1.6 | 3.8 |
| 7 | 4 | 0.5 | 16.0 | 2.4 | 5 | 2.3 | 2.4 | 3.4 | 7 | 8.6 | 3.2 | 5.4 |

(4) = All stresses in ksi; all lives in hours; all elongations in %

From Table VI, it can be seen that cold working to a 25% reduction generally results in increased 1900° F. stress-rupture strengths and that the grain coarsened bars demonstrate further increases in 1900° F. stress-rupture strength. It is noted from Table V that specimens (Bars No. 1 and 4) corresponding to Bars No. 1 and 4 of Table VI grain coarsen at temperatures below 1900° F., so that these Bars No. 1 and 4 in the cold-worked condition grain coarsened on heating up to the 1900° F. test temperature and the subsequent 2400° F. anneal for ½ hour had no apparent beneficial effect on their strength properties.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A powder metallurgy product consisting essentially of by weight, at least one element from the group consisting of about 10% to about 40% chromium and about 1% to about 10% aluminum, and up to about 10% nickel, up to about 20% cobalt, up to about 5% titanium, up to about 2% each of rare earth metal, yttrium, zirconium, columbium, hafnium, tantalum, silicon, and/or vanadium, up to about 6% each of tungsten and molybdenum, up to about 0.4% carbon, up to 0.4% manganese, and the balance iron, and further, including, by volume, about 0.1% to about 10% refractory dispersoid material selected from the group consisting of refractory metal oxide, metal carbide, metal nitride, metal boride, and combinations thereof, and having an average particle size of about 50A to 5000A and a melting point of at least about 2750° F., said dispersoid material being in the form of particles distributed substantially uniformly throughout said product; said product having a density of at least about 98% theoretical and being characterized by elongated grains about 10 to 100 microns wide and about 50 to 2000 microns long, and said grains being substantially stable at temperatures up to at least about 2400° F., said product being formed by consolidation of a mixture containing dispersoid particles or precursors thereof uniformly distributed through such mixture, and said product exhibiting substantially no loss in room temperature ductility upon exposure to 2400° F for at least about 100 hours.

2. A powder metallurgy product as defined in claim 1, comprising, by weight, about 15% to 40% chromium, up to about 5% cobalt, up to about 6% nickel, up to about 7% aluminum, up to about 0.5% zirconium and up to about 1% titanium, and further comprising, by volume, about 0.25% to about 5% refractory dispersoid material.

3. A powder metallurgy product as defined in claim 1, wherein said aluminum is present in an amount of at least about 2%.

4. A powder metallurgy product as defined in claim 1, wherein said chromium is present in an amount of about 18% to about 26%.

5. A powder metallurgy product as defined in claim 1, wherein said refractory dispersoid material is selected from the group consisting essentially of refractory oxides, carbides, nitrides and/or borides of thorium, zirconium, hafnium, and/or titanium; refractory oxide of silicon, uranium, magnesium, calcium, beryllium, and/or aluminum; and rare earth oxide.

6. A powder metallurgy product as defined in claim 1, wherein said dispersoid material is distributed therethrough at an average interparticle distance of about 500A to about 2500A.

7. A powder metallurgy product as defined in claim 6, wherein said average interparticle distance is about 660A to about 1800A.

8. Mill products, including sheet, bar, wire, tubing and plate, made of an alloy consisting essentially of, be weight, at least one element from the group consisting of about 10% to about 40% chromium and about 1% to about 10% aluminum, and up to about 10% nickel, up to about 20% cobalt, up to about 5% titanium, up to about 2% each of rare earth metal, yttrium, zirconium, columbium, hafnium, tantalum, silicon, and/or vanadium, up to about 6% each of tungsten and molybdenum, up to about 0.4% carbon, up to 0.4% manganese, and the balance iron, and further including, by volume, about 0.1% to about 10% refractory dispersoid material selected from at least one of the group consisting of a rare earth metal oxide, yttrium oxide and zirconium oxide and having an average particle size of about 50A to 5000A said mill products being characterized by elongated grains about 10 to 100 microns wide and about 50 to 2,000 microns long.

9. A hot consolidated mechanically alloyed product consisting essentially of by weight, at least one element from the group consisting of about 10% to about 40% chromium and about 1% to about 10% aluminum, up to about 10% nickel, up to about 20% cobalt, up to about 5% titanium, up to about 2% each of rare earth metal, yttrium, zirconium, columbium, hafnium, tantalum, silicon, and/or vanadium, up to about 6% each of tungsten and molybdenum, up to about 0.4% carbon, up to about 0.4% manganese, and the balance iron, and further, including, by volume, about 0.1% to about 10% refractory dispersoid material selected from the group consisting essentially of refractory metal oxide, metal carbide, metal nitride, metal boride, and combinations thereof, and having an average particle size of about 50A to 5000A and a melting point of at least about 2750° F., said dispersoid material being in the form of particles distributed substantially uniformly throughout said product; said product having a density of at least about 98% theoretical and being characterized by elongated grains about 10 to 100 microns wide and about 50 to 2000 microns long, and said grains being substantially stable at temperatures up to at least about 2400° F.

10. A mechanically alloyed product as defined in claim 9, wherein said refractory dispersoid material comprises yttria.

11. A powder metallurgy product consisting essentially of by weight, at least one element from the group consisting of about 10% to about 40% chromium and about 1% to about 10% aluminum, and up to about 10% nickel, up to about 20% cobalt, up to about 5% titanium, up to about 2% each of rare earth metal, yttrium, zirconium, columbium, hafnium, tantalum, silicon, and/or vanadium, up to about 6% each of tungsten and molybdenum, up to about 0.4% carbon, up to 0.4% manganese, and the balance iron, and further, including, by volume, about 0.1% to about 10% refractory dispersoid material selected from at least one of the group consisting of a rare earth metal oxide, yttrium oxide and zirconium oxide, and having an average particle size of about 50A to 5000A, said dispersoid material being in the form of particles distributed substantially uniformly throughout said products; said product having a density of at least about 98% theroretical and being characterized by elongated grains about 10 to 100 microns wide and about 50 to 2000 microns long, and said grains being substantially stable at temperatures up to at least about 2400° F.

12. A powder metallurgy product as defined in claim 1, wherein said dispersoid is introduced into the said mixture, as discrete dispersoid particles.

13. A powder metallurgy product as defined in claim 1, wherein said dispersoid is formed in-situ from an initial charge of a precursor metal convertible to an oxide and an oxide readily reducible with respect to said precursor metal.

* * * * *

UNITED STATES PATENT AND TRADEMARK OFFICE

CERTIFICATE OF CORRECTION

PATENT NO. : 3,992,161

DATED : November 16, 1976

INVENTOR(S) : ROBERT LACOCK CAIRNS and JOHN STANWOOD BENJAMIN

It is certified that error appears in the above-identified patent and that said Letters Patent are hereby corrected as shown below:

Col. 3, line 37: After "titanium;" insert --and contain, by volume,--.

Correct the preamble in claims 2 and 6 so that line 1 in each reads as follows:

--A hot consolidated mechanically alloyed product as defined in claim 9--.

Correct the preamble in claims 3 and 4 so that line 1 in each reads as follows:

--A hot consolidated mechanically alloyed product as defined in claim 2--.

Please add the following claims:

--14. A hot consolidated mechanically alloyed product as defined in claim 9 comprising, by weight, about 18% to about 26% chromium, about 3% to about 7% aluminum, up to about 1% titanium and further comprising, by volume, about 0.25% to about 5% yttria.--

UNITED STATES PATENT AND TRADEMARK OFFICE

CERTIFICATE OF CORRECTION

PATENT NO. :3,992,161

DATED :November 16, 1976

INVENTOR(S) :ROBERT LACOCK CAIRNS and JOHN STANWOOD BENJAMIN

It is certified that error appears in the above-identified patent and that said Letters Patent are hereby corrected as shown below:

--15. A hot consolidated mechanically alloyed product as defined in claim 14 wherein zirconium is present in an amount up to about 0.5% by weight.

16. A powder metallurgy product as defined in claim 1 comprising, by weight, about 18% to about 26% chromium, about 3% to about 7% aluminum, up to about 1% titanium, and further comprising, by volume, about 0.25% to about 5% yttria.

17. A powder metallurgy product as defined in claim 16 wherein zirconium is present in an amount up to about 0.5% by weight.--

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*